US011248437B2

(12) United States Patent
Ornelaz et al.

(10) Patent No.: US 11,248,437 B2
(45) Date of Patent: Feb. 15, 2022

(54) SYSTEM TO CONTROL SWAB OFF WHILE RUNNING A PACKER DEVICE

(71) Applicant: Halliburton Energy Services, Inc., Houston, TX (US)

(72) Inventors: Richard Decena Ornelaz, Frisco, TX (US); Stephen Michael Greci, Little Elm, TX (US); Xiaoguang Allan Zhong, Plano, TX (US); James Dan Vick, Jr., Dallas, TX (US); Peter C. Dagenais, The Colony, TX (US); Abdel Hamid R. Abeidoh, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 16/640,320

(22) PCT Filed: Nov. 14, 2017

(86) PCT No.: PCT/US2017/061553
§ 371 (c)(1),
(2) Date: Feb. 19, 2020

(87) PCT Pub. No.: WO2019/098993
PCT Pub. Date: May 23, 2019

(65) Prior Publication Data

US 2021/0079756 A1 Mar. 18, 2021

(51) Int. Cl.
*E21B 33/12* (2006.01)
*E21B 33/128* (2006.01)
*E21B 33/129* (2006.01)

(52) U.S. Cl.
CPC ..... *E21B 33/128* (2013.01); *E21B 33/1208* (2013.01); *E21B 33/1293* (2013.01); *E21B 2200/08* (2020.05)

(58) Field of Classification Search
CPC .. E21B 33/1208; E21B 2200/08; E21B 23/00; E21B 33/1212; E21B 33/128;
(Continued)

(56) References Cited

U.S. PATENT DOCUMENTS 927,874 A * 7/1909 Robinson ..... E21B 33/1208 277/341
2,069,212 A * 2/1937 Buffington ..... F16J 15/3284 277/439

(Continued)

FOREIGN PATENT DOCUMENTS

GB 2520583 B 10/2015
WO 2013115924 A1 8/2013

OTHER PUBLICATIONS

International Search Report and Written Opinion dated Aug. 10, 2018; International PCT Application No. PCT/US2017/061553.

*Primary Examiner* — Daniel P Stephenson
(74) *Attorney, Agent, or Firm* — McGuire Woods LLP

(57) ABSTRACT

Disclosed embodiments include a packer. The packer includes a fluid bypass positioned along a longitudinal axis of the packer. The fluid bypass provides a fluid flow path between a downhole location and an uphole location from the packer. Additionally, the packer includes a sealing element positioned around the fluid bypass that is elastically deformable to expand in a direction radially outward from the longitudinal axis when the sealing element experiences axial compression. The sealing element includes at least one elastomeric seal reinforcer molded into the elastomeric seal.

20 Claims, 9 Drawing Sheets

(58) Field of Classification Search
CPC ..... E21B 33/1291; E21B 33/1293; E21B 33/1294; E21B 33/12955; E21B 41/00
See application file for complete search history.

(56) References Cited

U.S. PATENT DOCUMENTS 2,196,668 A * 4/1940 Ragan ..... E21B 33/128 166/122
2,464,713 A * 3/1949 Penick ..... E21B 33/1291 166/138
2,738,015 A * 3/1956 Lynes ..... E21B 33/1216 277/340
3,268,275 A * 8/1966 Laghlin ..... E21B 17/1042 175/325.2
3,339,637 A 9/1967 Holden
3,436,084 A * 4/1969 Courter ..... E21B 33/129 277/338
3,918,523 A * 11/1975 Stuber ..... E21B 33/14 166/285
4,441,551 A * 4/1984 Biffle ..... E21B 33/085 166/84.3
4,452,463 A * 6/1984 Buckner ..... E21B 33/1216 166/196
4,900,067 A * 2/1990 Jansen ..... E21B 33/04 285/123.12
5,641,019 A 6/1997 Stout et al.
5,904,354 A * 5/1999 Collins ..... E21B 33/128 277/328
6,142,227 A * 11/2000 Hiorth ..... E21B 33/129 166/123
7,387,158 B2 * 6/2008 Murray ..... E21B 33/1208 166/179
7,448,445 B2 * 11/2008 Doane ..... E21B 33/1208 166/138
8,191,644 B2 * 6/2012 Rytlewski ..... E21B 33/1208 166/387
8,839,874 B2 * 9/2014 Bishop ..... E21B 33/128 166/387
9,091,133 B2 * 7/2015 Stewart ..... E21B 23/00
9,145,755 B2 * 9/2015 Farquhar ..... E21B 33/128
9,334,702 B2 * 5/2016 Allen ..... E21B 33/12
9,506,315 B2 11/2016 Connelly
9,670,747 B2 * 6/2017 Ruffo ..... E21B 33/1208
10,633,947 B2 * 4/2020 Fripp ..... E21B 33/12
10,655,411 B2 * 5/2020 Fripp ..... E21B 33/1208
2005/0199401 A1 * 9/2005 Patel ..... E21B 33/1208 166/387
2008/0087417 A1 4/2008 Doane et al.
2008/0099209 A1 5/2008 Loretz et al.
2008/0149351 A1 6/2008 Marya et al.
2009/0242215 A1 * 10/2009 Eatwell ..... E21B 33/1285 166/387
2012/0061105 A1 3/2012 Neer et al.
2018/0045016 A1 * 2/2018 Radtke ..... E21B 33/1208
2021/0079756 A1 * 3/2021 Ornelaz ..... E21B 33/1293

* cited by examiner

SYSTEM TO CONTROL SWAB OFF WHILE RUNNING A PACKER DEVICE

BACKGROUND

The present disclosure relates generally to packers used within a subterranean wellbore, and more specifically to a system that reduces a likelihood of swab off (i.e., pre-setting) while running the packers into the wellbore.

While preparing a well for production, it may be beneficial at certain times to seal a space between an outside portion of production tubing within the well and a casing or wellbore wall of the well. The packer provides the seal by gripping against the casing or the wellbore wall upon activation of the packer. When the packer experiences forces associated with deployment of the packer to a downhole position (e.g., due to running the packer too quickly downhole in a low radial clearance well, or due to circulating fluid too quickly around the packer), a rubber element of the packer used to generate the seal may begin to swab off. Swabbing off means that the rubber element begins to compress into a set or active position of the packer. Such an action while the packer is running downhole within the well may inflict damage on the rubber element prior to the packer reaching a desired sealing location within the wellbore.

Decreasing the speed of the deployment of the packer may limit swab off of the rubber element. However, decreasing the speed of the deployment reduces efficiency of preparing the well for production. Reducing the efficiency may result in increased labor costs and increases in downtime of the well during a well completion period.

BRIEF DESCRIPTION OF THE DRAWINGS

Illustrative embodiments of the present disclosure are described in detail below with reference to the attached drawing figures, which are incorporated by reference herein, and wherein.

Figure 1:
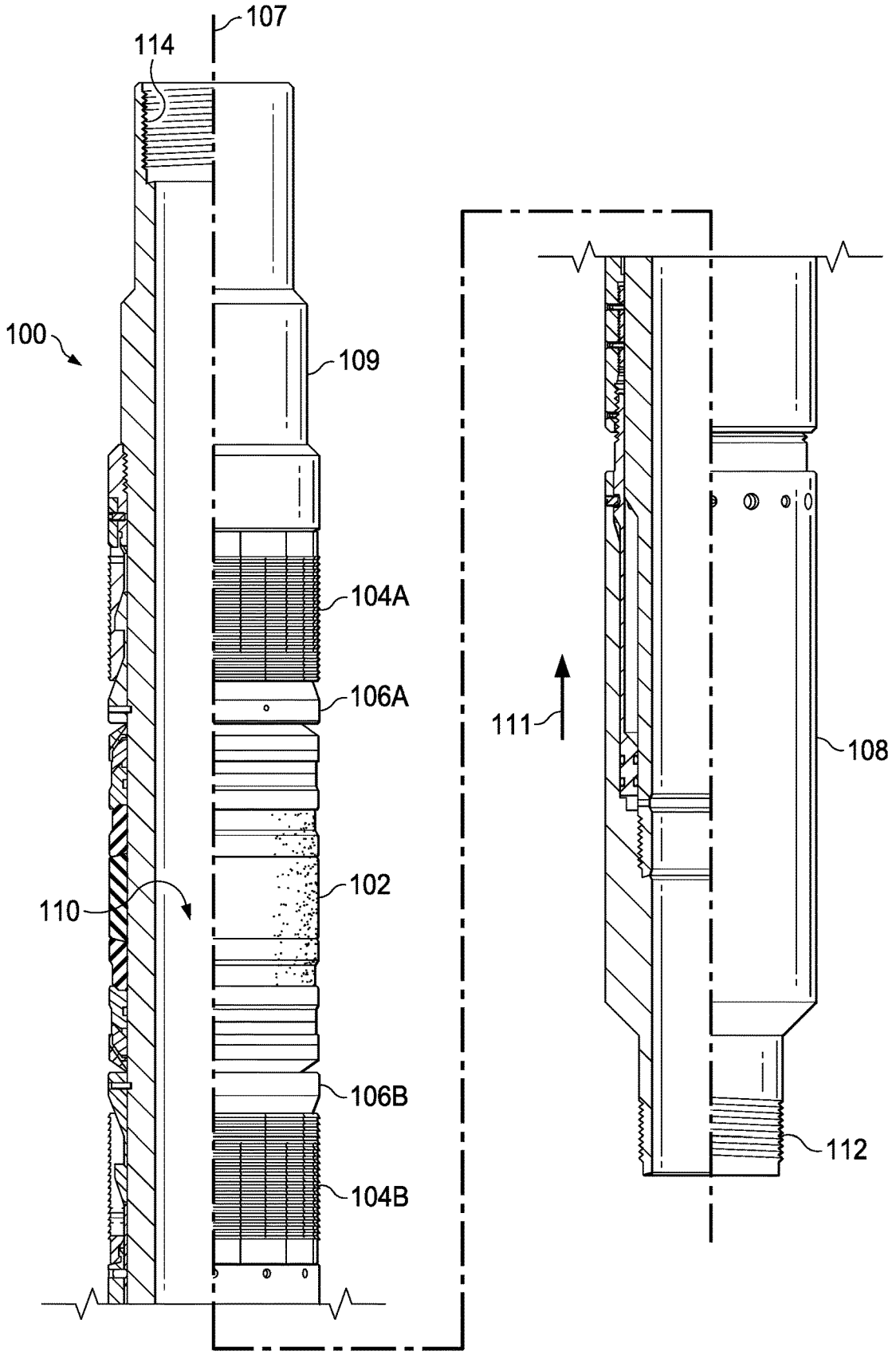
FIG. 1 is a cutaway view of a packer.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the embodiments and figures provided below are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a production packer that provides a capability to seal portions of a well between production tubing and a wellbore wall or casing of the well. More particularly, the present disclosure relates to reinforcement techniques for an elastomeric seal of the production packer to prevent swab off of the elastomeric seal while the production packer is run to a desired position within the well or while swapping fluids within the well resulting in high fluid velocities around the production packer. Swab off may be defined as an incidental activation of the elastomeric seal, or any other components of the packer, while the packer is run down hole or during fluid swapping within the well. In general, reinforcement techniques include sheet metal, mesh, cables, sleeves, and other materials disposed within or around the elastomeric seal or other moving components of the packer. The materials disposed within or around the elastomeric seal provide the ability to stiffen the elastomeric seal without increasing the durometer of the elastomeric seal. As used herein, the term durometer is defined as a hardness scale where a greater durometer indicates that a material is harder than another material with a lower durometer. When dealing with elastomeric sealing elements, an elastomeric seal with a lower durometer may provide enhanced sealing capabilities when compared to an elastomeric sealing element with a higher durometer.

The presently disclosed embodiments may be used in either onshore or offshore drilling operations. The packer may be deployed within the wellbore using a slickline, an electric line, using a hydraulic setting on a workstring within the well, or using any other suitable downhole tool deployment technique. Embodiments may be implemented to deploy a packer to a downhole location within the wellbore in an efficient manner while limiting a likelihood of swab off of the elastomeric seal or pre-setting of any other components of the packer.

Referring to FIG. 1, a cutaway view of a packer 100 is provided. The packer 100 includes an elastomeric seal 102 that, upon activation, expands to provide a seal at a wellbore wall or at a casing wall located within a well. Also included on the packer 100 is an uphole slip 104A and a downhole slip 104B. The slips 104A and 104B include ridges or teeth on an outer surface of the slips 104A and 104B to grip the casing or the wellbore wall when the packer is activated. Upon activation of the packer, the slips 104A and 104B travel over wedges 106A and 106B, respectively, to move in a radially outward direction from a longitudinal axis 107 of the packer. The slips 104A and 104B continue to move in the radially outward direction until the ridges or teeth of the slips 104A and 104B make contact with the casing or the wellbore wall of the well.

Activation of the packer 100 may be provided using an electric or hydraulic actuator positioned at a downhole sub 108. The actuator at the downhole sub 108 moves components of the packer 100 positioned downhole from an uphole sub 109 and the slip 104A in an uphole direction 111. In moving the components of the packer 100 in the direction 111 while maintaining the uphole sub 109 and the slip 104A stationary, the elastomeric seal 102 is compressed and expanded in a radially outward direction from the longitudinal axis 107 of the packer 100 to make sealing contact with the wellbore wall or the casing of the well. That is, the elastomeric seal 102 moves in a direction radially outward from the longitudinal axis 107 when the sealing element 102 experiences axial compression. Further, the slips 104A and 104B are also forced in a radially outward direction from the longitudinal axis 107 by the wedges 106A and 106B until the slips 104A and 104B make contact with the wellbore wall or the casing of the well.

Once the elastomeric seal 102 and the slips 104A and 104B are activated, wellbore fluids downhole from the packer 100 travel uphole from the packer 100 through a fluid bypass 110 that runs through a central portion of the packer 100 along the longitudinal axis 107. Additional production tubing may be connected downhole from the packer 100 using a male threaded region 112 of the downhole sub 108. Further, additional production tubing may be connected uphole from the packer 100 using a female threaded region 114 of the uphole sub 109.

Figure 2A:
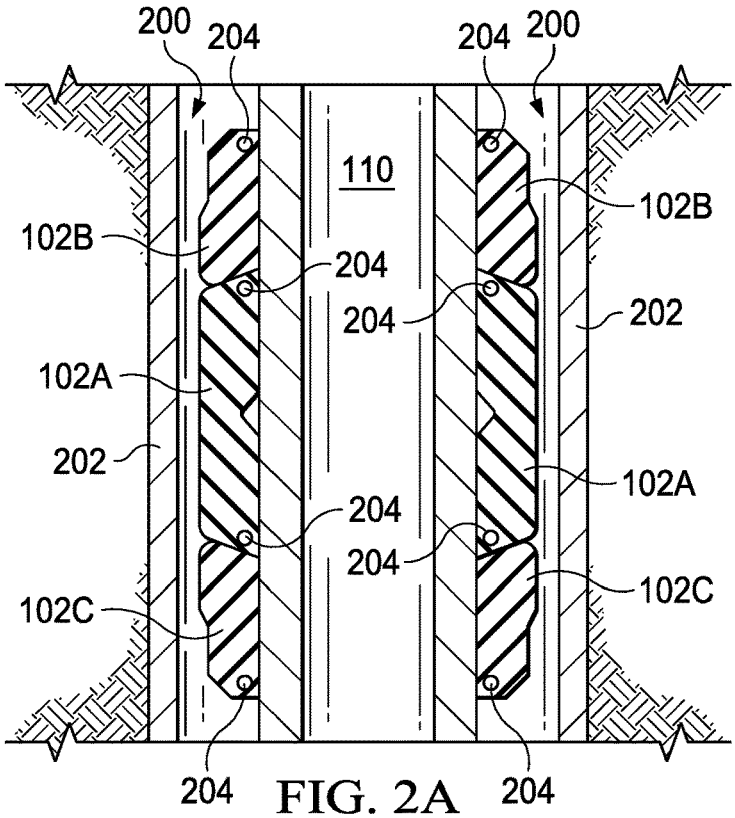
FIG. 2A is a sectional view of an embodiment of an elastomeric seal of the packer of FIG. 1 while deployed within a wellbore.

FIG. 2A is a sectional view of an embodiment of the elastomeric seal 102 of the packer 100 while deployed within a wellbore 200. The elastomeric seal 102, as illustrated, includes a central section 102A and two outer sections 102B and 102C. In other embodiments, the elastomeric seal 102 may include only a single section (e.g., the central section 102A) without the outer sections 102B and 102C. Further, the elastomeric seal 102 may include more sections than the three sections 102A-102C depicted in FIG. 2A. Generally, the two outer sections 102B and 102C are stiffer and shorter than the central section 102A to provide support for the central section 102A when the packer 100 is activated into a sealing position. The central section 102A is longer and made from a softer elastomeric material (i.e., an elastomeric material with a lower durometer) than the outer sections 102B and 102C to provide a secure seal at the wellbore wall or casing 202 when the packer 100 is activated into the sealing position. By way of example, the central section 102A may include a durometer of 70, while the two outer sections 102B and 102C may include a durometer of 90.

In the illustrated embodiment, to help prevent swab off while running the packer 100 downhole, the sections 102A-102C of the elastomeric seal 102 include cables 204 molded within the sections 102A-102C. As illustrated, the cables 204 are molded into the elastomeric seal 102 as rings. The cables 204 may generally increase stiffness of the elastomeric seal 102 without impacting an effectiveness of the seal between the wellbore wall or casing 202 and the elastomeric seal 102. Increasing the stiffness of the elastomeric seal 102 prevents swab off of the elastomeric seal 102 when the packer 100 is run downhole within the wellbore 200. The cables 204 may be made from metals and alloys (e.g., carbon steel, stainless steel, nickel alloys, etc.), continuous fibers (e.g., carbon fibers, aramid fibers, glass fibers, ceramic fibers, nanotubes, etc.), titanium, thermoplastics, thermoset materials, or any other materials suitable for use as the cables 204.

Figure 2B:
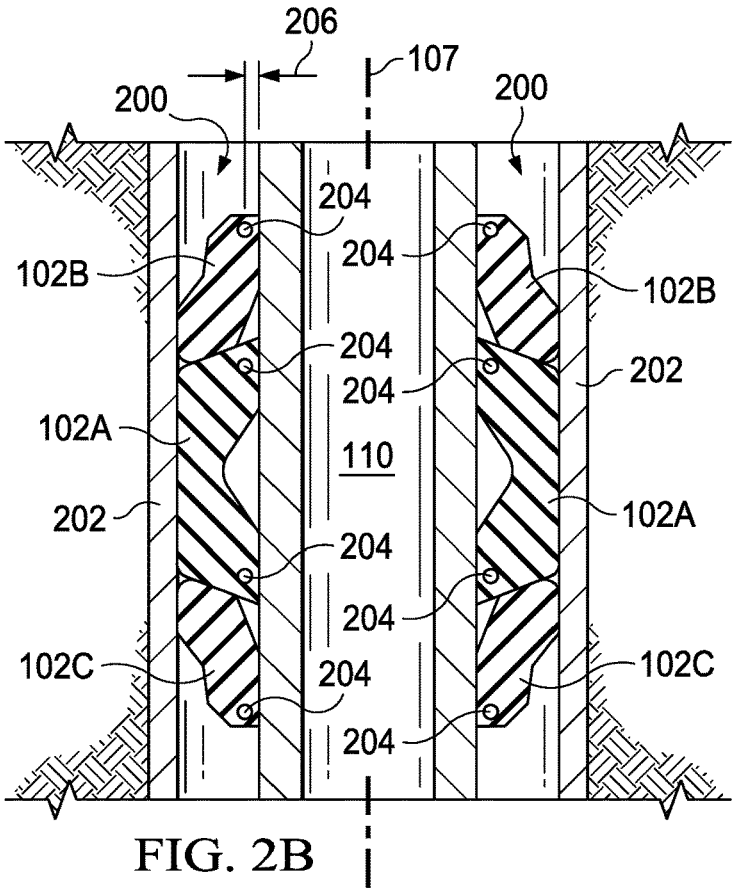
FIG. 2B is a sectional view of the elastomeric seal of FIG. 2A in an expanded state.

Turning to FIG. 2B, a sectional view of the elastomeric seal 102 in an expanded state is provided. When in the expanded state, the elastomeric seal 102 is in contact with the wellbore wall or casing 202. In this manner, the elastomeric seal 102 seals a space within the wellbore 200 between the fluid bypass 110 of the packer 100 and the wellbore wall or casing 202. The resulting seal forces the flow of fluid from a downhole location within the wellbore 200 to travel through the fluid bypass 110 of the packer 100. The cables 204, as illustrated, are positioned in locations within the elastomeric seal 102 where minimal expansion occurs upon activation of the elastomeric seal 102. For example, the cables 204 may generally be positioned in locations of the elastomeric seal 102 where only movement in a direction parallel to the longitudinal axis 107 is expected. When the cables 204 are in such a position, the cables 204 maintain a distance 206 from the fluid bypass 110 in both a sealing position (e.g., as depicted in FIG. 2B) and a non-sealing position (e.g., as depicted in FIG. 2A) of the packer 100.

Figure 3A:
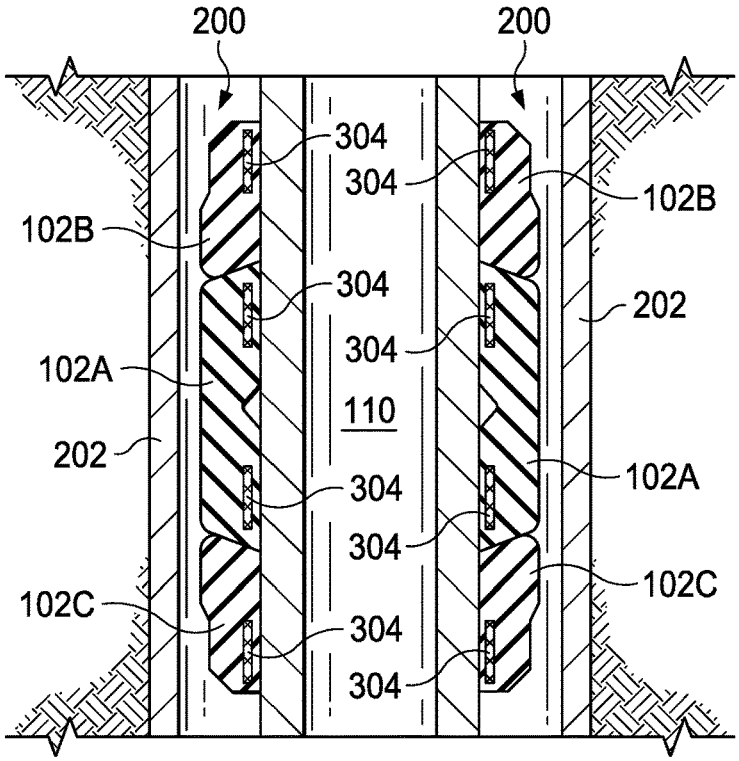
FIG. 3A is a sectional view of an embodiment of an elastomeric seal of the packer of FIG. 1 while deployed within a wellbore.

FIG. 3A is a sectional view of an embodiment of the elastomeric seal 102 of the packer 100 while deployed within a wellbore 200. The elastomeric seal 102, as illustrated, includes the central section 102A and the two outer sections 102B and 102C. In other embodiments, the elastomeric seal 102 may include only a single section (e.g., the central section 102A) without the outer sections 102B and 102C. Further, the elastomeric seal 102 may include more sections than the three sections 102A-102C depicted in FIG. 3A. Generally, the two outer sections 102B and 102C are stiffer and shorter than the central section 102A to provide support for the central section 102A when the packer 100 is activated into a sealing position. The central section 102A is longer and made from a softer elastomeric material than the outer sections 102B and 102C to provide a secure seal at the wellbore wall or casing 202 when the packer 100 is activated into the sealing position.

In the illustrated embodiment, to help prevent swab off while running the packer 100 downhole, the sections 102A-102C of the elastomeric seal 102 include mesh 304 molded within the sections 102A-102C. The mesh 304, operating in a similar manner to the cables 204 discussed above with reference to FIGS. 2A and 2B, may generally increase stiffness of the elastomeric seal 102 without impacting an effectiveness of the seal between the wellbore wall or casing 202 and the elastomeric seal 102. Increasing the stiffness of the elastomeric seal 102 prevents swab off of the elastomeric seal 102 when the packer 100 is run downhole within the wellbore 200. The mesh 304 may be made from metals and alloys (e.g., carbon steel, stainless steel, nickel alloys, etc.), titanium, thermoplastics, thermoset materials, or any other material suitable for use as the mesh 304. An expansive nature of the mesh 304 may enable the mesh 304 to expand at least partially with the elastomeric seal 102 upon activation of the packer 100 while providing increased stiffness to the elastomeric seal 102 when the packer 100 is run to a downhole location within the wellbore 200.

Figure 3B:
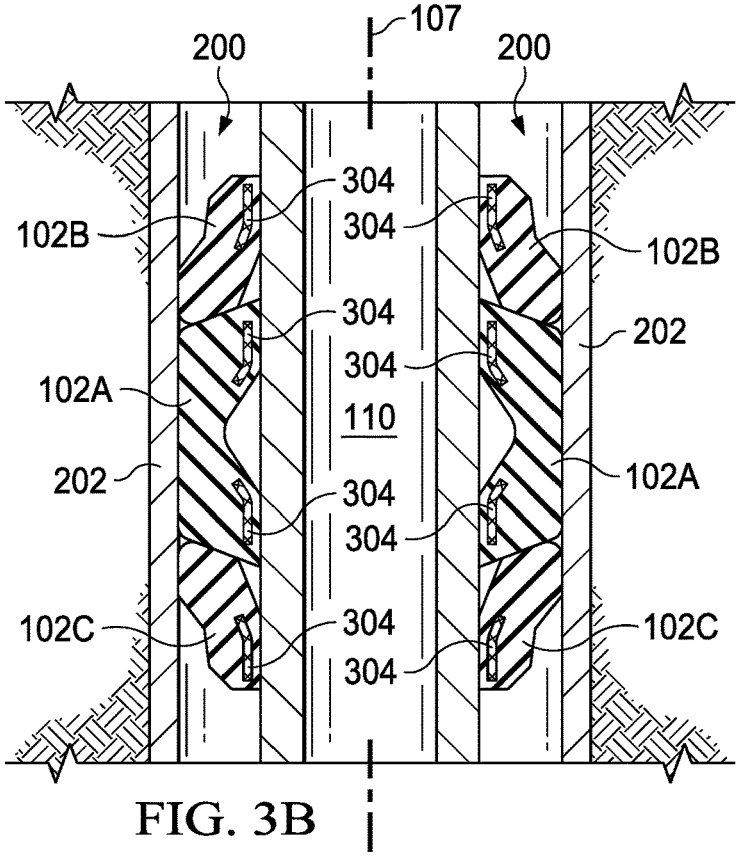
FIG. 3B is a sectional view of the elastomeric seal of FIG. 3A in an expanded state.

Turning to FIG. 3B, a sectional view of the elastomeric seal 102 in an expanded state is provided. When in the expanded state, the elastomeric seal 102 is in contact with the wellbore wall or casing 202. In this manner, the elastomeric seal 102 seals a space within the wellbore 200 between the fluid bypass 110 of the packer 100 and the wellbore wall or casing 202. The resulting seal forces the flow of fluid from a downhole location within the wellbore 200 to travel through the fluid bypass 110 of the packer 100. The mesh 304 may be positioned at locations within the elastomeric seal 102 where minimal expansion occurs upon activation of the elastomeric seal 102. However, because a woven structure of the mesh 304 lends itself to a greater degree of expansion than the cables 204, the mesh 304 may also extend to regions within the elastomeric seal 102 that extend in a direction radially outward from the longitudinal axis 107. Thus, the mesh 304 may be molded into a larger percentage of the elastomeric seal 102 than the cables 204 to provide the stiffening effect on the elastomeric seal 102 without increasing the durometer of the elastomeric seal 102.

Figure 4A:
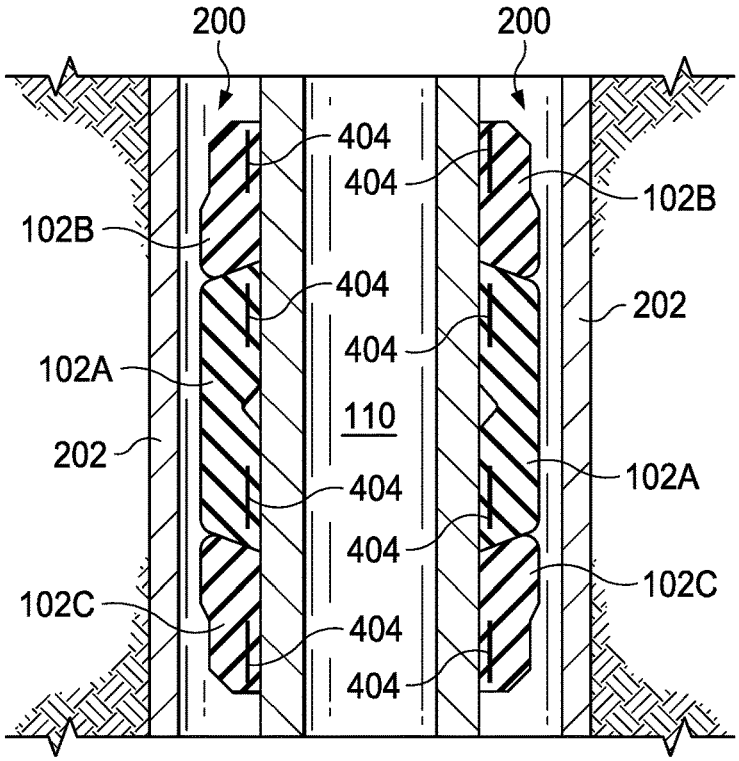
FIG. 4A is a sectional view of an embodiment of an elastomeric seal of the packer of FIG. 1 while deployed within a wellbore.

FIG. 4A is a sectional view of an embodiment of the elastomeric seal 102 of the packer 100 while deployed within a wellbore 200. The elastomeric seal 102, as illustrated, includes the central section 102A and the two outer sections 102B and 102C. In other embodiments, the elastomeric seal 102 may include only a single section (e.g., the central section 102A) without the outer sections 102B and 102C. Further, the elastomeric seal 102 may include more sections than the three sections 102A-102C depicted in FIG. 4A. Generally, the two outer sections 102B and 102C are stiffer and shorter than the central section 102A to provide support for the central section 102A when the packer 100 is activated into a sealing position. The central section 102A is longer and made from a softer elastomeric material than the outer sections 102B and 102C to provide a secure seal at the wellbore wall or casing 202 when the packer 100 is activated into the sealing position.

In the illustrated embodiment, to help prevent swab off while running the packer 100 downhole, the sections 102A-102C of the elastomeric seal 102 include sheet metal rings 404 molded within the sections 102A-102C. The sheet metal rings 404 may generally increase stiffness of the elastomeric seal 102 without impacting an effectiveness of the seal between the wellbore wall or casing 202 and the elastomeric seal 102. Increasing the stiffness of the elastomeric seal 102 prevents swab off of the elastomeric seal 102 when the packer 100 is run downhole within the wellbore 200. The sheet metal rings 404 may be made from metals and alloys (e.g., carbon steel, stainless steel, nickel alloys, etc.), titanium, thermoplastics, thermoset materials, or any other materials suitable for use as the sheet metal rings 404.

Figure 4B:
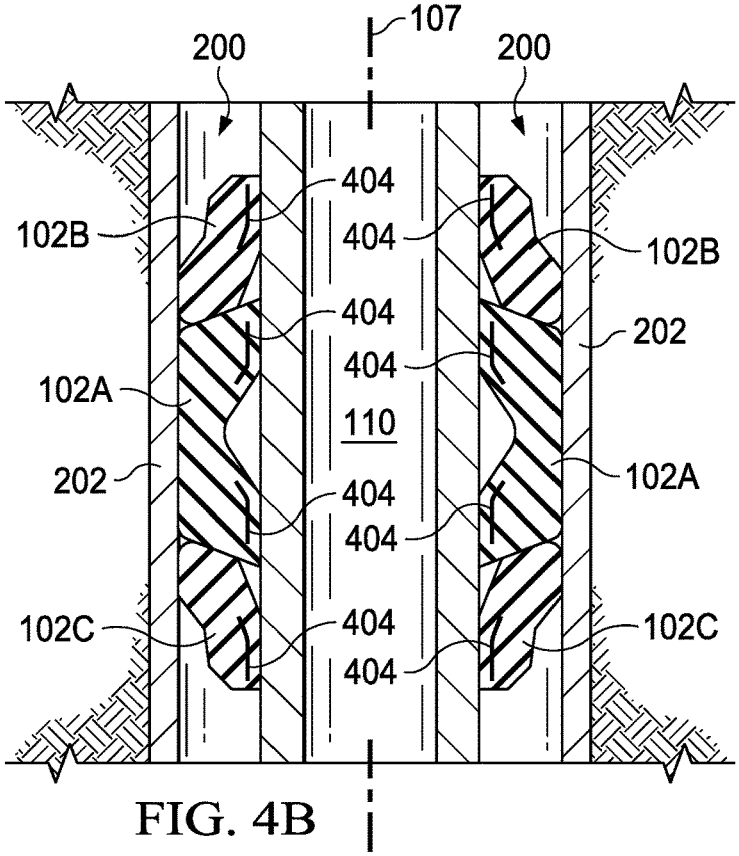
FIG. 4B is a sectional view of the elastomeric seal of FIG. 4A in an expanded state.

Turning to FIG. 4B, a sectional view of the elastomeric seal 102 in an expanded state is provided. When in the expanded state, the elastomeric seal 102 is in contact with the wellbore wall or casing 202. In this manner, the elastomeric seal 102 seals space within the wellbore 200 between the fluid bypass 110 of the packer 100 and the wellbore wall or casing 202. The resulting seal forces the flow of fluid from a downhole location within the wellbore 200 to travel through the fluid bypass 110 of the packer 100. The sheet metal rings 404, as illustrated, are positioned in locations within the elastomeric seal 102 along edges of the sections 102A-102C. For example, the sheet metal rings 404 may generally be positioned in locations of the elastomeric seal 102 where movement in a direction radially outward from the longitudinal axis 107 is at its smallest.

Figure 5:
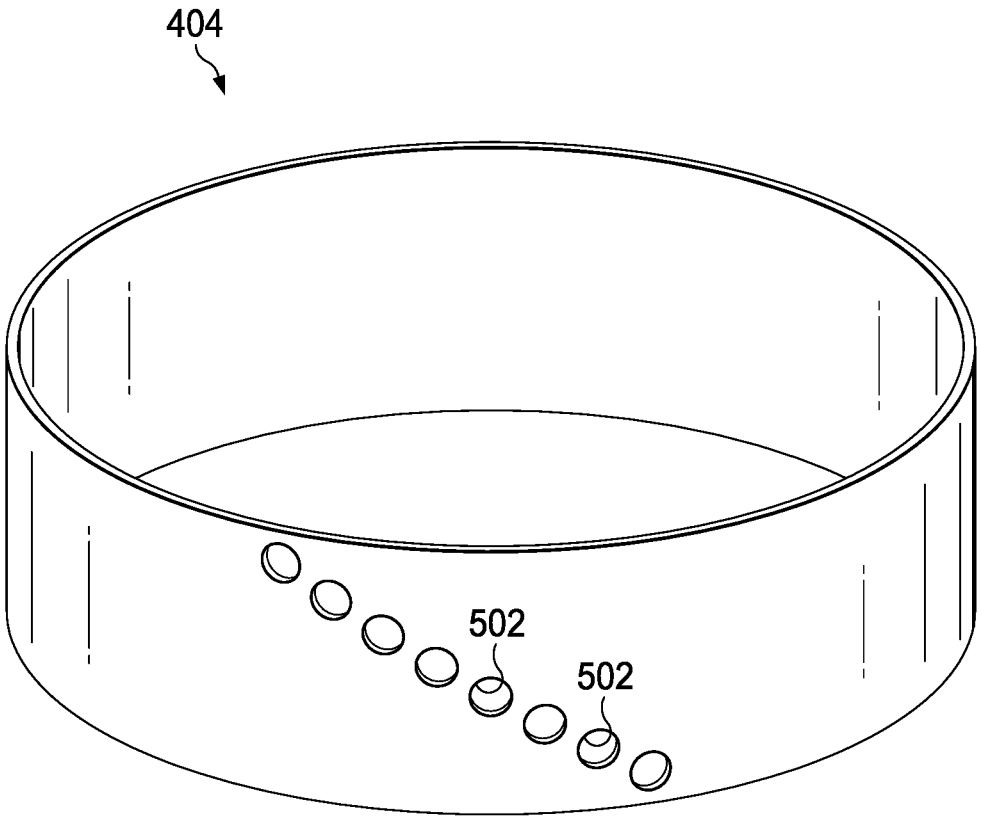
FIG. 5 is a perspective view of a sheet metal ring provided within the elastomeric seal of FIGS. 4A and 4B.

To enable the elastomeric seal 102 to extend in the radially outward direction from the longitudinal axis 107, the sheet metal rings 404 may include an engineered weak point 502, as depicted in FIG. 5. In such an embodiment, when the elastomeric seal 102 begins to experience a force associated with moving the elastomeric seal 102 into a sealing position, the engineered weak point 502 breaks. When the engineered weak point 502 breaks, the sheet metal ring 404 is able to expand along with the elastomeric seal 102. The engineered weak point 502 may be made from perforations in the sheet metal ring 404, as illustrated in FIG. 5. In other embodiments, the engineered weak point 502 may include a thin section of metal in the sheet metal ring 404 at the engineered weak point 502 that is designed to break upon experiencing pressure associated with sealing the packer 100. In another embodiment, the engineered weak point 502 may be made from a different type of material from a remainder of the sheet metal ring 404 that is chosen to break at a lower stress than the remainder of the sheet metal ring 404. In any embodiment, the sheet metal ring 404 may be made from any metal or other material (e.g., a plastic) that is able to provide adequate support to the elastomeric seal 102 to prevent swab off of the elastomeric seal 102 when the packer 100 is run downhole within the wellbore 200.

The cables 204, the mesh 304, and the sheet metal ring 404 may all generally be referred to as elastomeric seal reinforcers. While specific structures are provided above to describe the elastomeric seal reinforcers, it may be appreciated that other structures molded into the elastomeric seal 102 are also contemplated without departing from the scope of the present disclosure. Further, any combination of the different elastomeric seal reinforcers (e.g., cables 204, mesh 304, and sheet metal rings 404) within an individual embodiment of the elastomeric seal 102 is also contemplated.

Figure 6A:
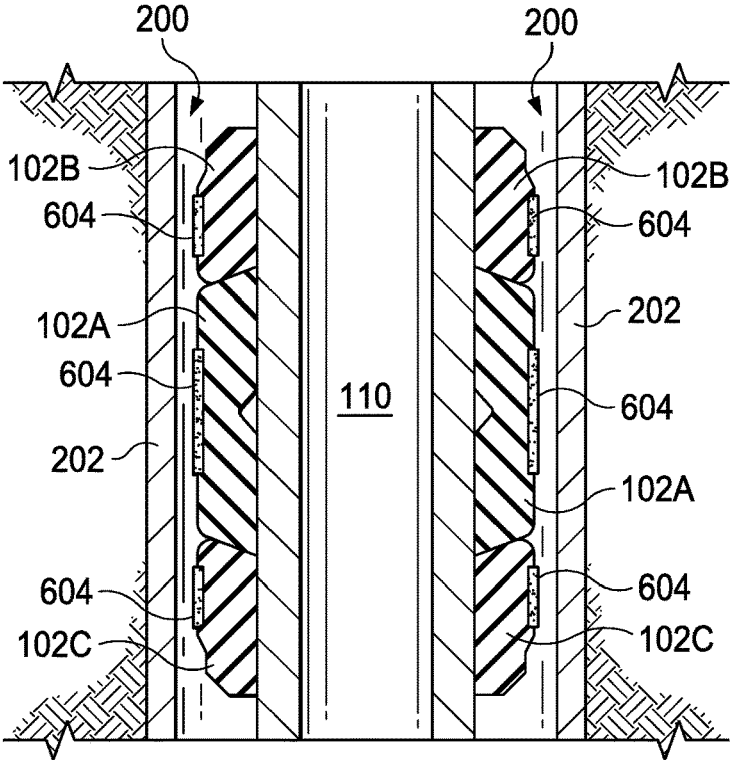
FIG. 6A is a sectional view of an embodiment of an elastomeric seal of the packer of FIG. 1 while deployed within a wellbore.

FIG. 6A is a sectional view of an embodiment of the elastomeric seal 102 of the packer 100 while deployed within the wellbore 200. In the illustrated embodiment, to help prevent swab off while running the packer 100 downhole, the sections 102A-102C of the elastomeric seal 102 include rings 604 installed on an outer surface of the sections 102A-102C. The rings may be installed on the outer surface of the sections 102A-102C such that they extend beyond the sections 102A-102C in a radially outward direction from the longitudinal axis 107. In another embodiment, the sections 102A-102C include grooves (not shown) that receive the rings 604 such that the outer edge of the rings 604 are flush with an outer edge of the sections 102A-102C. The rings 604 may generally increase stiffness of the elastomeric seal 102 while the packer 100 is run downhole within the wellbore 200 without ultimately impacting an effectiveness of the seal between the wellbore wall or casing 202 and the elastomeric seal 102. Increasing the stiffness of the elastomeric seal 102 prevents swab off of the elastomeric seal 102 when the packer 100 is run downhole within the wellbore 200.

The rings 604 may include a controlled disappearing capability. For example, the rings 604 may be made with a eutectic, reactive, or dissolvable material that dissolves or melts by the time the packer 100 reaches a desired depth within the wellbore 200. In such an embodiment, the rings 604 may be made from degradable polymers (e.g., Polyglycolide (PGA)), eutectic alloys, galvanic composition, aluminum, salt, compressed wood product, or other degradable materials. By way of example, the rings 604 made of eutectic material may dissolve at approximately 180 degrees Fahrenheit. Other rings 604 made from reactive or dissolvable material may be designed to melt or dissolve after a certain amount of time exposed to wellbore fluids. In another embodiment, the rings 604 may be made from a benign material that does not interfere with a setting process of the packer 100. For example, the benign material may stretch with the elastomeric seal 102 and/or the benign material may be cut in a way that enables high expansion without rupturing. In such an embodiment, the rings 604 may be made from metals and alloys (e.g., carbon steel, stainless steel, nickel alloys, etc.), titanium, thermoplastics, thermoset materials, or any other materials sufficient for use as the rings 604. In any embodiment, the rings 604 provide no mechanical limitation to setting the elastomeric seal 102 of the packer 100 once the packer 100 is activated upon reaching a desired downhole location.

The eutectic, reactive, or dissolvable material may be chosen to make up the rings 604 such that the rings 604 dissolve or melt either when the packer 100 reaches the desired depth or shortly after the packer 100 reaches the desired depth within the wellbore 200. An operator may control a running speed of the packer 100 based on both an estimate of time to dissolve or melt the rings 604 after exposure to wellbore fluids and temperatures and a desired downhole location of the packer 100 within the wellbore 200. In either option, the rings 604 are maintained when the packer 100 is run at a quick rate and/or when there is a high fluid flow rate around the packer 100 prior to the packer 100 reaching the desired downhole location.

Figure 6B:
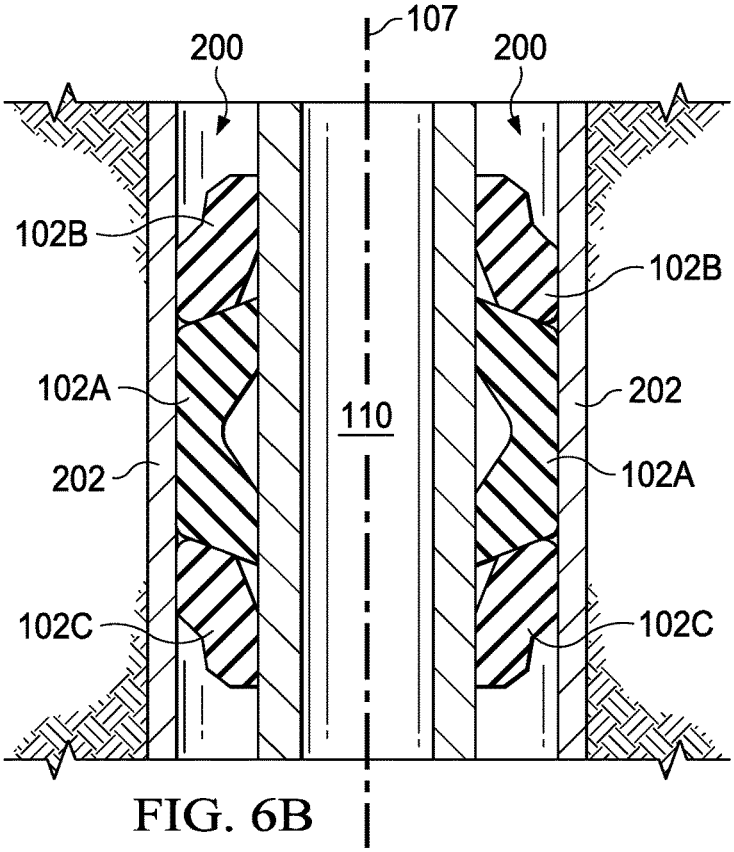
FIG. 6B is a sectional view of the elastomeric seal of FIG. 6A in an expanded state.

FIG. 6B is a sectional view of the elastomeric seal 102 of FIG. 6A in an expanded state. As illustrated, the rings 604 positioned on an outer diameter of the elastomeric seal 102 have dissolved or melted such that the elastomeric seal 102 is no longer constrained by the rings 604. In another embodiment, the rings 604 made from a benign material may remain on the outer diameter of the elastomeric seal 102. In such an embodiment, the rings 604 expand in a direction radially outward from the longitudinal axis 107 along with the elastomeric seal 102. In another embodiment, the benign material of the rings 604 may break and fall away as the elastomeric seal 102 expands toward the wellbore wall or casing 202.

Figure 7A:
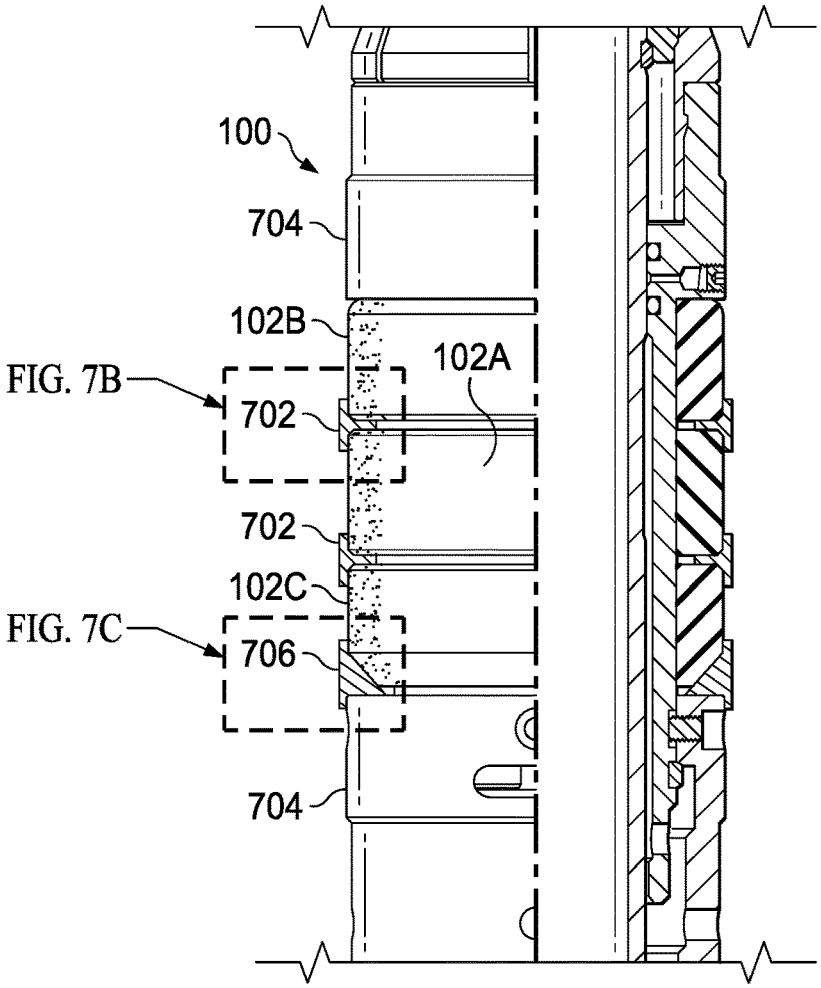
FIGS. 7A-7C are cutaway views of portions of a packer including sectional details of restraining bands used on an elastomeric seal of the packer.
Figure 7B:
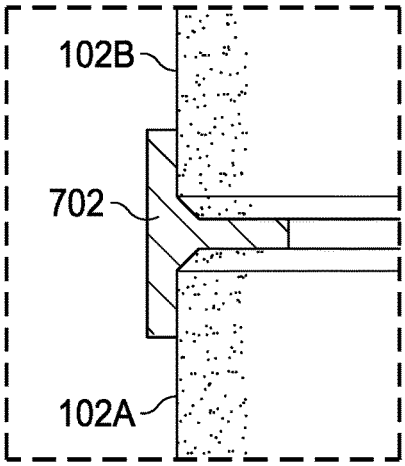
Figure 7C:
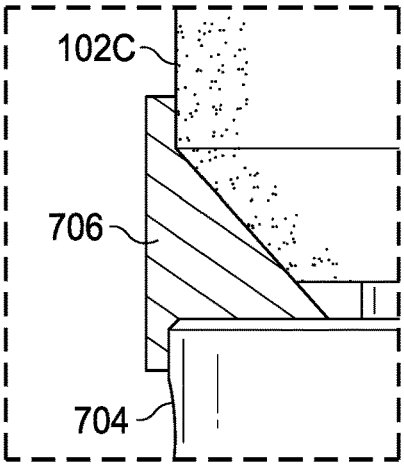

FIG. 7A is a cutaway view of a portion of a packer 100, and FIGS. 7B and 7C are sectional details of restraining bands 702 and 706 used on an elastomeric seal 102 of the packer 100. The restraining bands 702 and 706 may be made from a eutectic, reactive, or dissolvable material such that the restraining bands 702 and 706 are able to restrain the elastomeric seal 102 during run in of the packer 100 to prevent swab off of the elastomeric seal 102. By way of example, the restraining bands 702 and 706 may be made from degradable polymers (e.g., Polyglycolide (PGA)), eutectic alloys, galvanic composition, aluminum, salt, compressed wood product, or any other degradable materials suitable for use as the restraining bands 702 and 706. As illustrated, the restraining band 702 is a band that fits between sections 102A and 102B of the elastomeric seal 102 and/or between sections 102A and 102C of the elastomeric seal 102. The restraining band 702 is a ring with a T-shaped cross-section that surrounds the elastomeric seal 102. Similar to the rings 604 discussed above with respect to FIGS. 6A and 6B, the material that the restraining band 702 is made from may be chosen such that it dissolves or melts either upon the packer 100 arriving at the desired downhole depth or shortly thereafter. In general, the restraining bands 702 and 706 provide no mechanical limitations to setting the elastomeric seal 102 of the packer 100 once the packer 100 reaches a desired downhole location.

The restraining band 706 may be made from the same material as the restraining band 702 such that both restraining bands 702 and 706, when deployed together, dissolve or melt at approximately the same time. As illustrated, the restraining band 706 has a wedge-shaped cross-section, and the restraining band 706 fits between the section 102C of the elastomeric seal 102 and a shoe 704 of the packer 100. In an embodiment, an additional restraining band 706 may be positioned between the section 102B and the shoe 704 on an uphole side of the elastomeric seal 102. The positioning of the restraining band 706 prevents the section 102C from extending in a direction radially outward from the longitudinal axis 107 while the packer 100 is run down hole within the wellbore 200 prior to the dissolving or melting of the restraining band 706.

While FIG. 7A depicts two restraining bands 702 and two restraining bands 706 positioned around the elastomeric seal 102, more or fewer restraining bands 702 and 706 are contemplated as positionable around the elastomeric seal 102. For example, only a single restraining band 702 may be positioned between the section 102A and 102C and only a single restraining band 706 may be included between the section 102C and the shoe 704 to provide enhanced stiffness at a downhole portion of the elastomeric seal 102. In the illustrated embodiment, two restraining bands 702 and two restraining bands 706 are positioned around the elastomeric seal 102 such that each gap between the sections 102A-102C are filled with the restraining bands 702 and each gap between the sections 102B and 102C and the shoes 704 are filled with the restraining bands 706. As described herein, the rings 604 and the restraining bands 702 and 706 depicted in FIGS. 6A and 7A-7C may generally be described as elastomeric seal support bands.

Figure 8A:
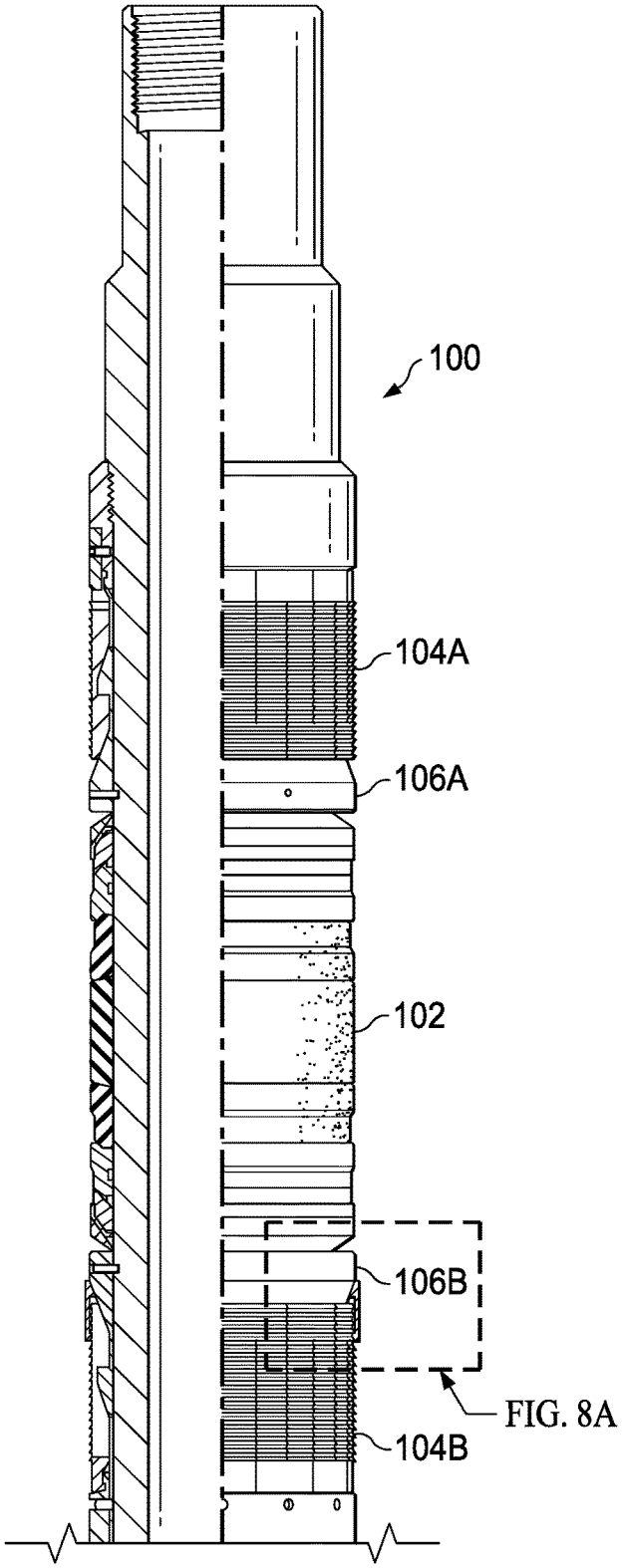
FIGS. 8A-8C are cutaway views of the packer of FIG. 1 including sectional details of slip retaining devices.
Figure 8B:
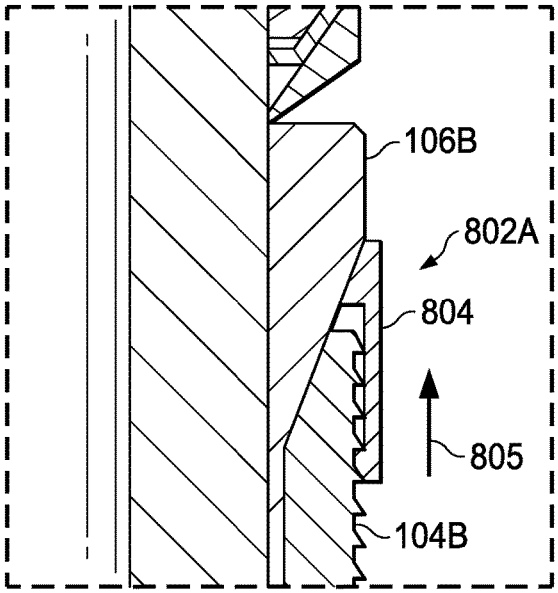
Figure 8C:
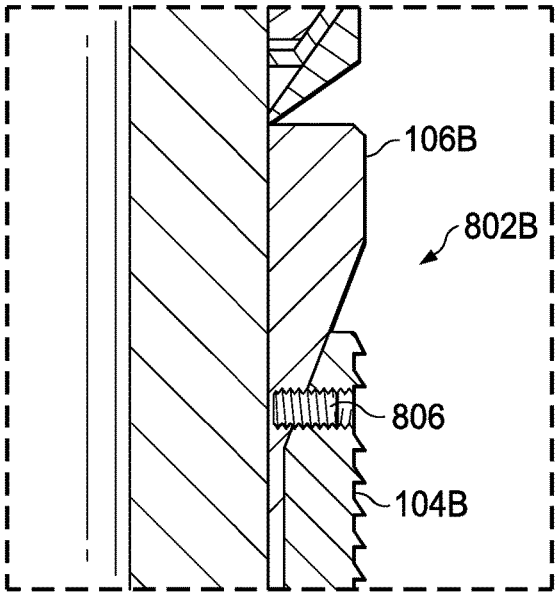

FIG. 8A is a cutaway view of the packer 100, and FIGS. 8B and 8C are sectional details 802A and 802B of slip retaining devices, respectively. The illustrated slip retaining devices include a band 804 that fits around a portion of the slip 104B closest to the wedge 106B. The band 804 may be made from a eutectic, reactive, or dissolvable material such that the band 804 is able to restrain the slip 104B during run in of the packer 100 to prevent the slip 104B from activating into a gripping state. By way of example, the band 804 may be made from degradable polymers (e.g., Polyglycolide (PGA)), eutectic alloys, galvanic composition, aluminum, salt, compressed wood product, or any other degradable materials suitable for use as the band 804. Prior to dissolving or melting, the band 804 abuts the wedge 106B such that both the band 804 and the slip 104B are prevented from moving uphole in a direction 805. Similar to the rings 604 discussed above with respect to FIGS. 6A and 6B, the material that the band 804 is made from may be chosen such that the material dissolves or melts either upon the packer 100 arriving at the desired downhole location or shortly thereafter. In general, the band 804 provides no mechanical limitation to setting the slip 104B of the packer 100 once the packer 100 reaches the desired downhole location.

The illustrated slip retaining devices, as shown in the sectional detail 802B of FIG. 8C, also include a shear screw 806 that extends through the slip 104B and the wedge 106B to retain the slip 104B in a deactivated position. The shear screw 806 may also be made from a eutectic, reactive, or dissolvable material such that the shear screw 806 is able to restrain the slip 104B during run in of the packer 100 to prevent the slip 104B from activating into a gripping state. By way of example, the shear screw 806 may be made from degradable polymers (e.g., Polyglycolide (PGA)), eutectic alloys, galvanic composition, aluminum, salt, compressed wood product, or any other degradable materials suitable for use as the shear screw 806. In another embodiment, the shear screw 806 may be designed to withstand the forces applied on the slip 104B during run-in of the packer 100, but also designed to shear when the packer 100 experiences forces associated with a transition to a gripping state within the wellbore 200 (e.g., upon activation of the packer 100 at the desired downhole location). In general, the shear screw 806 provides no mechanical limitation to setting the slip 104B of the packer 100 once the packer 100 reaches the desired downhole location.

The slip 104B may include one or both of the band 804 and the shear screw 806. While FIGS. 8A-8C depict the band 804 and the shear screw 806 positioned on a downhole end of the elastomeric seal 102, the band 804 and/or the shear screw 806 may also be included at the slip 104A and wedge 106A to maintain the slip 104A in a deactivated position.

Figure 9:
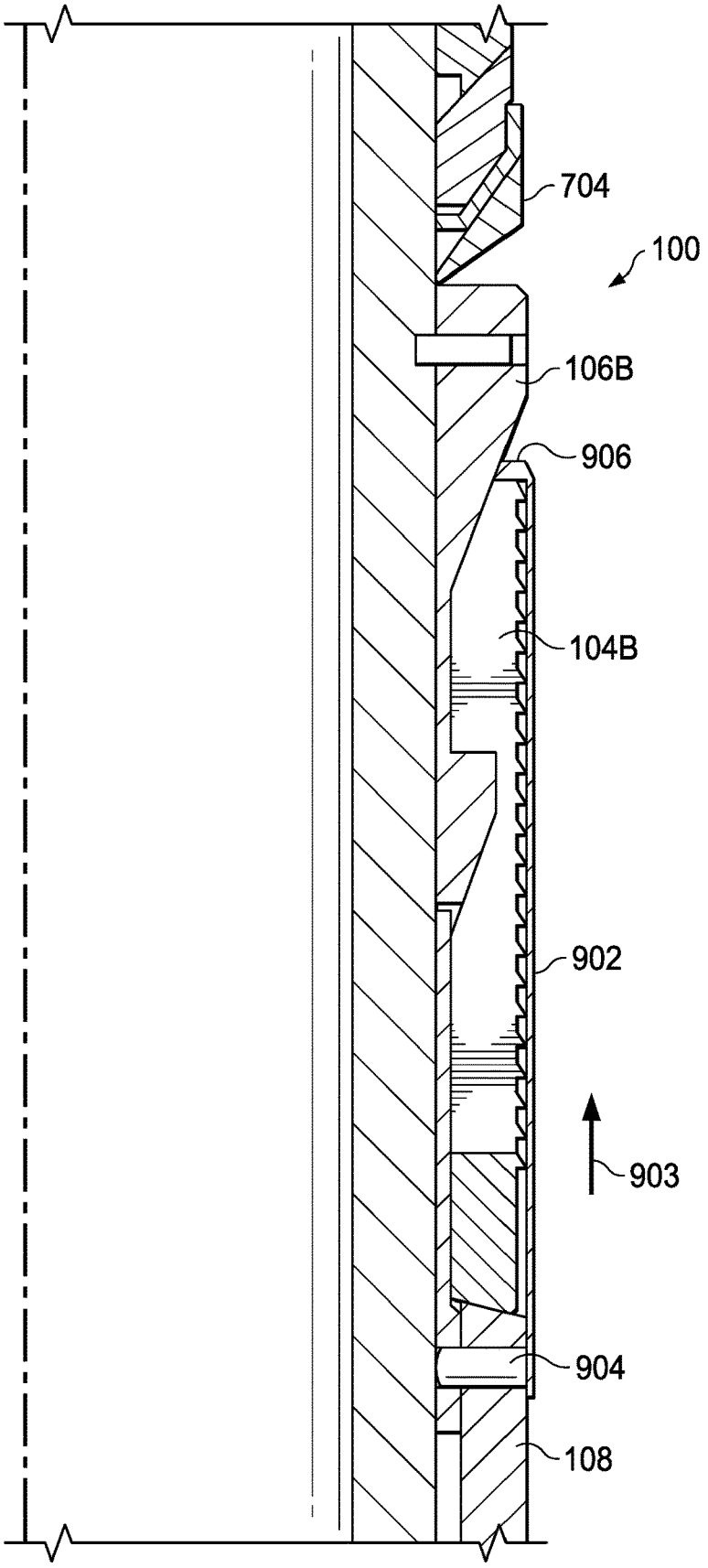
FIG. 9 is a sectional view of a portion of the packer of FIG. 8A including a slip sleeve.

FIG. 9 is a sectional view of a portion of the packer 100 including a slip sleeve 902. The slip sleeve 902 may operate in a similar manner to the band 804 discussed in detail above with reference to FIGS. 8A-8C. For example, the slip sleeve 902 may be made from a eutectic, reactive, or dissolvable material such that the slip sleeve 902 is able to restrain the slip 104B during run in of the packer 100 to prevent the slip 104B from activating into a gripping state. The slip sleeve 902 may be made from degradable polymers (e.g., Polyglycolide (PGA)), eutectic alloys, galvanic composition, aluminum, salt, compressed wood product, or any other degradable materials suitable for use as the slip sleeve 902. Prior to dissolving or melting, the slip sleeve 902 abuts the wedge 106B such that both the slip sleeve 902 and the slip 104B are prevented from moving uphole in a direction 903. Similar to the rings 604 discussed above with respect to FIGS. 6A and 6B, the material that the slip sleeve 902 is made from may be chosen such that the material dissolves or melts either upon the packer 100 arriving at the desired downhole depth or shortly thereafter. In general, the slip sleeve 902 provides no mechanical limitation to setting the slip 104B of the packer 100 once the packer 100 reaches a desired downhole location.

The slip sleeve 902, which covers the entire slip 104B, may be anchored to the packer 100 using an anchor 904. As illustrated, the anchor 904 is coupled or integral to the slip sleeve 902, and the anchor 904 extends through a portion of the downhole sub 108 of the packer 100. The anchor 902, in combination with a stop 906 of the slip sleeve 902 abutting the wedge 106B, contribute to a force that maintains the slip 104B in a deactivated position until the wedge 106B dissolves or melts. While FIG. 9 depicts the slip sleeve 902 positioned on a downhole end of the elastomeric seal 102, the slip sleeve 902 may also be included at the slip 104A and wedge 106A to maintain the slip 104A in a deactivated position. As used herein, the band 804, the shear screw 806, and the slip sleeve 902 may generally be referred to as slip retention devices.

While the discussion above generally relates to the elastomeric seal 102 that includes sections 102A, 102B, and 102C, it may be appreciated that each of the disclosed embodiments may be performed using elastomeric seals 102 including more or fewer sections. For example, the elastomeric seal 102 may be made from a single section of elastomeric material, two sections of elastomeric material, or four or more sections of elastomeric material. That is, the embodiments described in detail above with respect to FIGS. 1-8 may be performed on elastomeric seals 102 that include any number of sections.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a packer, comprising: a fluid bypass positioned along a longitudinal axis of the packer configured to provide a fluid flow path between a downhole location and an uphole location from the packer; and a sealing element positioned around the fluid bypass that is elastically deformable to expand in a direction radially outward from the longitudinal axis when the sealing element experiences axial compression, the sealing element comprising: at least one elastomeric seal reinforcer molded into the elastomeric seal.

Clause 2, the assembly of clause 1, wherein sealing element comprises: a central section comprising a first elastomeric material with a first durometer; and a first outer section and a second outer section positioned on either side of the central section, the first outer section and the second outer section each comprising a second elastomeric material with a second durometer greater than the first durometer.

Clause 3, the assembly of clause 2, wherein the central section, the first outer section, and the second outer section each comprise at least one of the at least one elastomeric seal reinforcers molded into the elastomeric seal.

Clause 4, the assembly of at least one of clauses 1-3, wherein the at least one elastomeric seal reinforcer comprises a cable, a mesh, or a sheet metal ring.

Clause 5, the assembly of at least one of clauses 1-4, wherein the at least one elastomeric seal reinforcer is made from a metal, an alloy, a continuous fiber, a thermoplastic, or a thermoset material.

Clause 6, the assembly of at least one of clauses 1-5, wherein the at least one elastomeric seal reinforcer comprises a sheet metal ring comprising an engineered weak point.

Clause 7, the assembly of clause 6, wherein the engineered weak point is configured to break when the sealing element is activated into a sealing position.

Clause 8, the assembly of at least one of clauses 1-7, comprising: at least one slip positioned uphole or downhole from the sealing element; and at least one slip retention device configured to retain the slip in a deactivated position until the packer reaches a desired downhole location.

Clause 9, the assembly of at least one of clauses 1-8, wherein the at least one slip retention device comprises a band or a sleeve positioned around the at least one slip, and wherein the band or the sleeve are made from eutectic, reactive, or dissolvable materials.

Clause 10, the assembly of at least one of clauses 1-9, wherein the at least one slip retention device comprises a shear screw configured to shear upon activation of the packer at the desired downhole location.

Clause 11, a production packer system, comprising: a fluid bypass positioned along a longitudinal axis of the production packer system, wherein the fluid bypass provides a fluid flow path between a downhole location and an uphole location from the production packer system within a wellbore; a sealing element positioned around the fluid bypass that is elastically deformable to expand in a direction radially outward from the longitudinal axis when the sealing element experiences axial compression; and at least one elastomeric seal support band positioned around the sealing element, wherein the at least one elastomeric seal support band allows expansion of the sealing element when the production packer system reaches a desired downhole location.

Clause 12, the device of clause 11, wherein the elastomeric seal support band comprises a eutectic, reactive, or dissolvable material that melts or dissolves upon the production packer reaching the desired downhole location.

Clause 13, the device of clause 11 or 12, wherein the elastomeric seal support band comprises a benign material configured to stretch with the elastomeric seal when the elastomeric seal experiences axial compression.

Clause 14, the device of at least one of clauses 11-13, wherein the sealing element comprises multiple sections, and the at least one elastomeric seal support is positioned in a location that spans two or more of the multiple sections.

Clause 15, the device of at least one of clauses 11-14, comprising: at least one slip positioned uphole or downhole from the sealing element; and at least one slip retention device configured to retain the slip in a deactivated position until the production packer system reaches the desired downhole location.

Clause 16, the device of at least one of clauses 11-15, wherein the at least one slip retention device comprises a band or a sleeve positioned around the at least one slip, and wherein the band or the sleeve are made from eutectic, reactive, or dissolvable materials.

Clause 17, the device of at least one of clauses 11-16, further comprising a wedge, wherein the at least one slip retention device comprises a shear screw extending through the slip and the wedge.

Clause 18, an elastomeric sealing element, comprising: a central section comprising a first elastomeric material with a first durometer; a first outer section and a second outer section positioned on either side of the central section, the first outer section and the second outer section each comprising a second elastomeric material with a second durometer greater than the first durometer; and at least one elastomeric seal reinforcer molded into each of the central section, the first outer section, and the second outer section.

Clause 19, the elastomeric sealing element of clause 18, wherein the at least one elastomeric seal reinforcer comprises a cable, a mesh, or a sheet metal ring.

Clause 20, the assembly of clause 18 or 19, wherein the at least one elastomeric seal reinforcer comprises a sheet metal ring, and the sheet metal ring comprises an engineered weak point configured to break upon activation of the elastomeric sealing element.

While this specification provides specific details related to certain components related to a packer, it may be appreciated that the list of components is illustrative only and is not intended to be exhaustive or limited to the forms disclosed. Other components related to the operation of the packer will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A packer, comprising:

a fluid bypass positioned along a longitudinal axis of the packer configured to provide a fluid flow path between a downhole location and an uphole location from the packer;

a sealing element positioned around the fluid bypass that is elastically deformable to expand in a direction radially outward from the longitudinal axis when the sealing element experiences axial compression, the sealing element comprising:

at least one elastomeric seal reinforcer molded into the elastomeric seal;

at least one slip positioned uphole or downhole from the sealing element; and at least one slip retention device configured to retain the slip in a deactivated position until the packer reaches a desired downhole location; wherein the at least one slip retention device comprises a shear screw configured to shear upon activation of the packer at the desired downhole location.

2. The packer of claim 1, wherein sealing element comprises:

a central section comprising a first elastomeric material with a first durometer; and a first outer section and a second outer section positioned on either side of the central section, the first outer section and the second outer section each comprising a second elastomeric material with a second durometer greater than the first durometer.

3. The packer of claim 2, wherein the central section, the first outer section, and the second outer section each comprise at least one of the at least one elastomeric seal reinforcers molded into the elastomeric seal.

4. The packer of claim 1, wherein the at least one elastomeric seal reinforcer comprises a cable, a mesh, or a sheet metal ring.

5. The packer of claim 1, wherein the at least one elastomeric seal reinforcer is made from a metal, an alloy, a continuous fiber, a thermoplastic, or a thermoset material.

6. The packer of claim 1, wherein the at least one elastomeric seal reinforcer comprises a sheet metal ring comprising an engineered weak point.

7. The packer of claim 6, wherein the engineered weak point is configured to break when the sealing element is activated into a sealing position.

8. The packer of claim 1, wherein the at least one slip retention device comprises a band or a sleeve positioned around the at least one slip, and wherein the band or the sleeve are made from eutectic, reactive, or dissolvable materials.

9. A production packer system, comprising:

a fluid bypass positioned along a longitudinal axis of the production packer system, wherein the fluid bypass provides a fluid flow path between a downhole location and an uphole location from the production packer system within a wellbore;

a sealing element positioned around the fluid bypass that is elastically deformable to expand in a direction radially outward from the longitudinal axis when the sealing element experiences axial compression; and at least one elastomeric seal support band positioned around the sealing element, wherein the at least one elastomeric seal support band allows expansion of the sealing element when the production packer system reaches a desired downhole location; wherein the elastomeric seal support band comprises a benign material configured to stretch with the elastomeric seal when the elastomeric seal experiences axial compression.

10. The production packer system of claim 9, wherein the elastomeric seal support band comprises a eutectic, reactive, or dissolvable material that melts or dissolves upon the production packer reaching the desired downhole location.

11. The production packer system of claim 9, wherein the sealing element comprises multiple sections, and the at least one elastomeric seal support is positioned in a location that spans two or more of the multiple sections.

12. The production packer system of claim 9, comprising:

at least one slip positioned uphole, downhole, or uphole and downhole from the sealing element; and at least one slip retention device configured to retain the slip in a deactivated position until the production packer system reaches the desired downhole location.

13. The production packer system of claim 12, wherein the at least one slip retention device comprises a band or a sleeve positioned around the at least one slip, and wherein the band or the sleeve are made from eutectic, reactive, or dissolvable materials.

14. The production packer system of claim 12, further comprising a wedge, wherein the at least one slip retention device comprises a shear screw extending through the slip and the wedge.

15. The production packer system of claim 9, wherein the sealing element comprises:

a central section comprising a first elastomeric material with a first durometer; and a first outer section and a second outer section positioned on either side of the central section, the first outer section and the second outer section each comprising a second elastomeric material with a second durometer greater than the first durometer.

16. The production packer system of claim 15, wherein the sealing element further comprises at least one elastomeric seal reinforcer molded into the elastomeric seal.

17. The production packer system of claim 16, wherein the central section, the first outer section, and the second outer section each comprise at least one of the at least one elastomeric seal reinforcers molded into the elastomeric seal.

18. The production packer system of claim 16, wherein the at least one elastomeric seal reinforcer comprises a cable, a mesh, or a sheet metal ring.

19. The production packer system of claim 16, wherein the at least one elastomeric seal reinforcer is made from a metal, an alloy, a continuous fiber, a thermoplastic, or a thermoset material.

20. The production packer system of claim 16, wherein the at least one elastomeric seal reinforcer comprises a sheet metal ring comprising an engineered weak point.

* * * * *